US009163392B2

(12) United States Patent
Wilson

(10) Patent No.: US 9,163,392 B2
(45) Date of Patent: Oct. 20, 2015

(54) REINFORCEMENT RIB AND OVERHEAD STRUCTURE INCORPORATING THE SAME

(71) Applicant: AIL International, Inc., Sackville (CA)

(72) Inventor: Michael W. Wilson, Sackville (CA)

(73) Assignee: AIL International, Inc. (CA)

( * ) Notice: Subject to any disclaimer, the term of this patent is extended or adjusted under 35 U.S.C. 154(b) by 0 days.

(21) Appl. No.: 13/852,693

(22) Filed: Mar. 28, 2013

(65) Prior Publication Data

US 2013/0263529 A1 Oct. 10, 2013

Related U.S. Application Data

(63) Continuation of application No. 12/035,643, filed on Feb. 22, 2008, now abandoned.

(51) Int. Cl.

| | |
|---|---|
| ***E01F 5/00*** | (2006.01) |
| ***E04B 1/32*** | (2006.01) |
| ***E04B 1/38*** | (2006.01) |

(52) U.S. Cl.

CPC . *E04B 1/32* (2013.01); *E01F 5/005* (2013.01); *E04B 1/38* (2013.01)

(58) Field of Classification Search

CPC ..... E01F 5/005; E04B 1/32; E04B 1/38
USPC ..... 405/124, 125, 126, 132, 149, 150.1, 405/151; 52/630, 671, 674

See application file for complete search history.

(56) References Cited

U.S. PATENT DOCUMENTS

| | | | | |
|---|---|---|---|---|
| 944,592 | A | | 12/1909 | Bonsall |
| 1,999,500 | A | | 5/1934 | Carswell |
| 4,099,359 | A | | 7/1978 | Sivachenko |
| 4,099,386 | A | | 7/1978 | Sagasta |
| 4,186,541 | A | | 2/1980 | Sivachenko |
| 4,527,372 | A | * | 7/1985 | Ryan ..... 52/334 |
| 4,563,107 | A | * | 1/1986 | Peterson ..... 405/124 |
| 4,966,082 | A | * | 10/1990 | Takeichi et al. ..... 105/422 |
| 5,326,191 | A | * | 7/1994 | Wilson et al. ..... 405/124 |
| 5,385,423 | A | * | 1/1995 | Abukawa ..... 403/245 |
| 5,833,394 | A | * | 11/1998 | McCavour ..... 405/126 |
| 6,050,746 | A | | 4/2000 | McCavour |
| D484,609 | S | | 12/2003 | Harrington |

FOREIGN PATENT DOCUMENTS

WO WO 2007073075 A1 * 6/2007

* cited by examiner

*Primary Examiner* — Benjamin Fiorello
(74) *Attorney, Agent, or Firm* — Barnes & Thornburg LLP

(57) ABSTRACT

A reinforcement rib for an overhead structure comprises a pair of sidewalls and a top wall that bridges one end of each sidewall. A lower flange extends outwardly from an opposite end of each sidewall. Each lower flange is adapted to be secured to the overhead structure.

45 Claims, 10 Drawing Sheets

REINFORCEMENT RIB AND OVERHEAD STRUCTURE INCORPORATING THE SAME

RELATED APPLICATION

This application is a continuation of co-pending U.S. patent application Ser. No. 12/035,643, filed Feb. 22, 2008.

FIELD OF THE INVENTION

The present invention generally relates to overhead structures and in particular, to a reinforcement rib and to an overhead structure incorporating the same.

BACKGROUND OF THE INVENTION

As rural and urban infrastructure continues to age and develop, there is a continual demand for cost-effective technologies relating to the construction and maintenance of highways, railways and the like. Often unappreciated but vitally important to the construction of such infrastructure is the underpass system. Underpass systems are typically designed to carry not only dead loads, but also live loads. While some of the most impressive underpass systems are used in mining or forestry applications where spans can exceed twenty (20) meters, they are also very common in regular highway construction to allow passage of railway, watercourses or other vehicular/pedestrian traffic. While concrete structures have been regularly employed for these purposes, such concrete structures are very expensive to install, cost prohibitive in remote areas, subject to strength weakening due to corrosion of the reinforcing metal, thereby requiring ongoing repair and are rigid limiting their use in certain environments.

In the field of overhead structures, such as for example but not limited to box culverts, circular and ovoid culverts, arch-type structures, encased concrete structures and other similar structures that make use of corrugated plate, there have been significant advances. For example, U.S. Pat. No. 5,118,218 to Musser et al. discloses a corrugated box culvert constructed from reinforced corrugated steel or aluminum sheets having very deep corrugations and a generally uniform bending moment profile for the whole length of the box culvert. By using significant material on the crown portions as well as on the haunch portions of the box culvert, significant loads can be carried by the box culvert. Ovoid and circular culvert structures are disclosed in U.K. Patent Application No. 2,140,848 where wing members are used to increase the load carrying capabilities of the culvert structures thereby to avoid bending of the crown portions of the culvert structures as live loads pass thereover.

U.S. Pat. No. 5,326,191 to Wilson et al. discloses a reinforced metal box culvert formed of interconnected corrugated metal sheets and having a crown, opposing sides and opposite curved haunches. Continuous corrugated metal sheet reinforcement is secured to at least the crown of the culvert and extends the length of the culvert which is effective in supporting the load. The metal sheet reinforcement has a profile which abuts the crown corrugations with the troughs of the metal sheet reinforcement being secured to the crests of the crown corrugations. The metal sheet reinforcement has a curvature complementary to the crown corrugations to facilitate securement. The metal sheet reinforcement enhances load carrying characteristics, reduces overburden requirements and allows the culvert to be used in large span applications.

U.S. Pat. No. 5,833,394 to McCavour et al. discloses a composite concrete reinforced corrugated metal arch-type structure comprising a first set of shaped corrugated metal plates interconnected in a manner to define a base arch structure with the corrugations extending transversely of the longitudinal length of the base arch structure and a second series of shaped corrugated metal plates interconnected in a manner to overlay the first set of interconnected metal plates of the base arch structure. The second series of metal plates has at least one corrugation extending transversely of the longitudinal length of the base arch structure with the troughs of the corrugations of the second series of metal plates secured to the crests of the first set of metal plates. The interconnected series of second metal plates and the first set of metal plates define individual, transversely extending, enclosed continuous cavities that are filled with concrete. The interior surfaces of the cavities for each of the first and second metal plates carry shear studs for providing a shear bond at the concrete-metal interface. The concrete filled cavities define curved beams transversing the base arch structure giving the base arch structure positive and negative bending resistance and combined bending and axial resistance to superimposed loads.

To provide resistance to deformation during construction of arch-type structures such as those discussed above, mechanically-stabilized earth construction techniques have been considered. For example, U.S. Pat. No. 4,618,283 to Hilfiker discloses an archway construction positioned over a pathway for supporting a crossroad or the like. The archway has three primary sections including an upper ceiling section which spans the pathway and which is supported on two vertical support sections positioned on opposite sides of the pathway. The three primary sections are each comprised of alternating layers of compacted soil fill and steel reinforcing mats, with the mats serving to stabilize the compacted soil fill. The ceiling section preferably includes at least three reinforcing mats, namely a lower flat mat and a pair of curved upper mats, with the three mats being separated by layers of compacted soil fill except in a central region midway between the vertical support sections where the three mats are connected together. The two upper curved mats of the ceiling section provide vertical support for the center of the lower flat mat.

U.S. Pat. No. 6,050,746 to McCavour et al. discloses a method for controlling deformation of an erected structural metal plate culvert or underpass during backfilling of the erected structure. The method comprises building progressively a reinforced earth retaining system on each side of the erected structure by alternately layering a plurality of compacted layers of earth with interposed layers of reinforcement to form reinforced earth on each side of the erected structure and securing each layer of reinforcement to its respective side of the structure. Securement of the layers of reinforcement to the sides of the erected structure controls deformation of the erected structure during backfilling. Each layer of reinforcement may be a plurality of strips extending away from the erected structure, or a reinforcement mat of interconnected rods.

In some instances such as for example in high load carrying environments, further reinforcement for overhead structures is required. To provide such further reinforcement, reinforcement ribbing secured to the exterior surface of the overhead structure has been considered. For example, FIG. 1*a* is an end view showing an archway 10 formed of interconnected corrugated metal plates or sheets. Reinforcement ribbing 14 is secured to the metal archway 10 at longitudinally spaced locations along the length of the metal archway 10. The reinforcement ribbing 14 at each location extends transversely of the longitudinal length of the metal archway 10. The reinforcement ribbing 14 at each location comprises, in this example, a plurality of reinforcement ribs 20 arranged end-to-end and extending along the crown portion and haunch portions of the metal archway 10.

FIGS. 1*b* and 1*c* show conventional reinforcement ribs 20. As can be seen, in each case the reinforcement rib 20 comprises a lower flange 30 having a curved undersurface 32 that rests on a crest of the metal archway 10. Fasteners (not shown) such as bolts pass through spaced holes in the lower flange 30 to secure the reinforcement rib 20 to the metal archway 10. An upstanding wall 34 intergral with the lower flange 30 runs the length of the lower flange. A head 36 is formed along the top of the upstanding wall 34. In the example of FIG. 1*b*, the head 36 is generally circular in cross-section and in FIG. 1*c*, the head 36 is generally rectangular in cross-section.

Although the reinforcement ribs 20 provide additional support, the reinforcement ribs are difficult to bend. Also, the reinforcement ribs 20 are typically formed using an extrusion process making the reinforcement ribs expensive to manufacture. Using extrusion also limits the size of the reinforcement ribs 20 that can be made. As will be appreciated, improvements in overhead structure reinforcement are desired.

It is therefore an object of the present invention at least to provide a novel reinforcement rib and overhead structure incorporating the same.

SUMMARY OF THE INVENTION

Accordingly, in one aspect there is provided a reinforcement rib for an overhead structure comprising a pair of sidewalls, a top wall bridging one end of each sidewall and a lower flange extending from an opposite end of each sidewall. Each lower flange is adapted to be secured to the overhead structure.

In one embodiment, the overhead structure is formed of corrugated plate and the lower flanges are secured to different crests of the corrugated plate. The reinforcement rib has an enclosed configuration. At least one structural element such as for example, an I-beam, a channel member or a plate member may be secured to the top wall. Alternatively, the top wall may be provided with at least one longitudinal feature such as for example, at least one groove.

In another embodiment, the reinforcement rib may have one or more shear studs thereon. The shear studs may extend from inner surfaces of at least one of the sidewalls and the top wall or from exterior surfaces of at least one of the sidewalls and the top wall.

According to another aspect there is provided an overhead structure comprising a corrugated structure having corrugations extending transversely of the longitudinal length of the corrugated structure and reinforcement ribbing extending transversely of the longitudinal length of the corrugated structure at, at least one location along the corrugated structure. The reinforcement ribbing is secured to a pair of crests of the corrugated structure and spans at least one trough of the corrugated structure.

In one embodiment, the reinforcement ribbing comprises a plurality of ribs fastened to the crests. The ribs are arranged end-to-end. At least one splice may span adjacent ribs. Alternatively, end regions of adjacent ribs may be nested.

BRIEF DESCRIPTION OF THE DRAWINGS

Embodiments will now be described with reference to the accompanying drawings in which.

DETAILED DESCRIPTION OF THE EMBODIMENTS

Figure 1A:
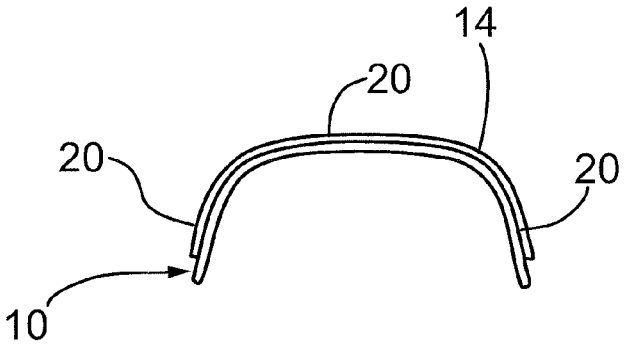
FIG. 1a (PRIOR ART)
FIG. 1*a* is an end view of a metal archway having prior art reinforcement ribbing thereon.
Figure 1B:
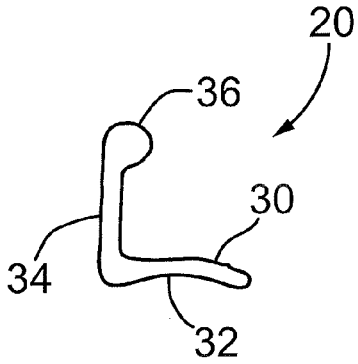
FIG. 1b (PRIOR ART)
FIGS. 1*b* and 1*c* are end views of prior art reinforcement ribs.
Figure 1C:
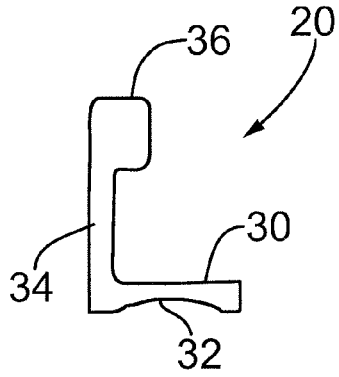
FIG. 1c (PRIOR ART)
Figure 2:
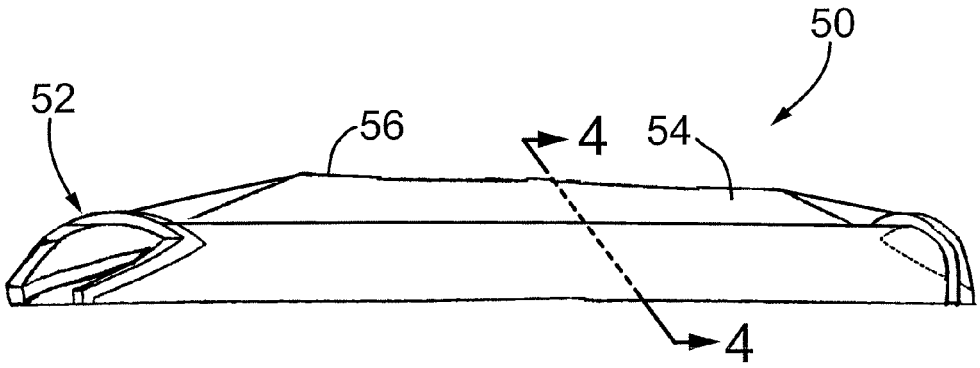
FIG. 2 is a perspective view of an underpass system comprising an arch-type structure.
Figure 3:
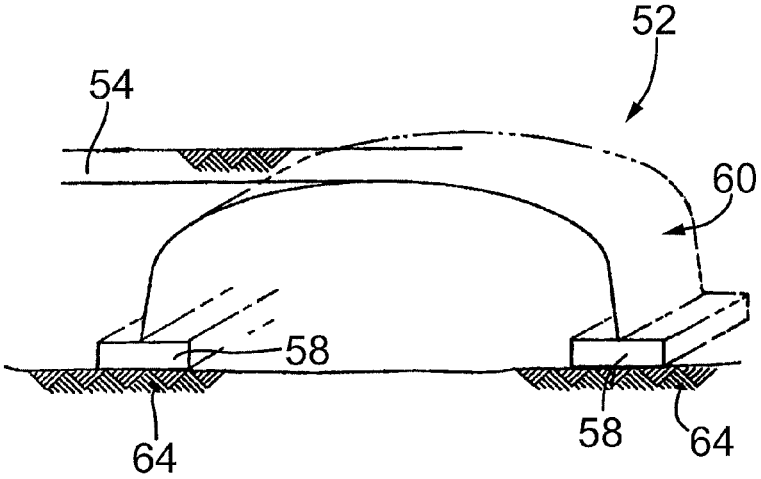
FIG. 3 is a perspective view of a metal archway and footings forming part of the arch-type structure of FIG. 2.
Figure 4:
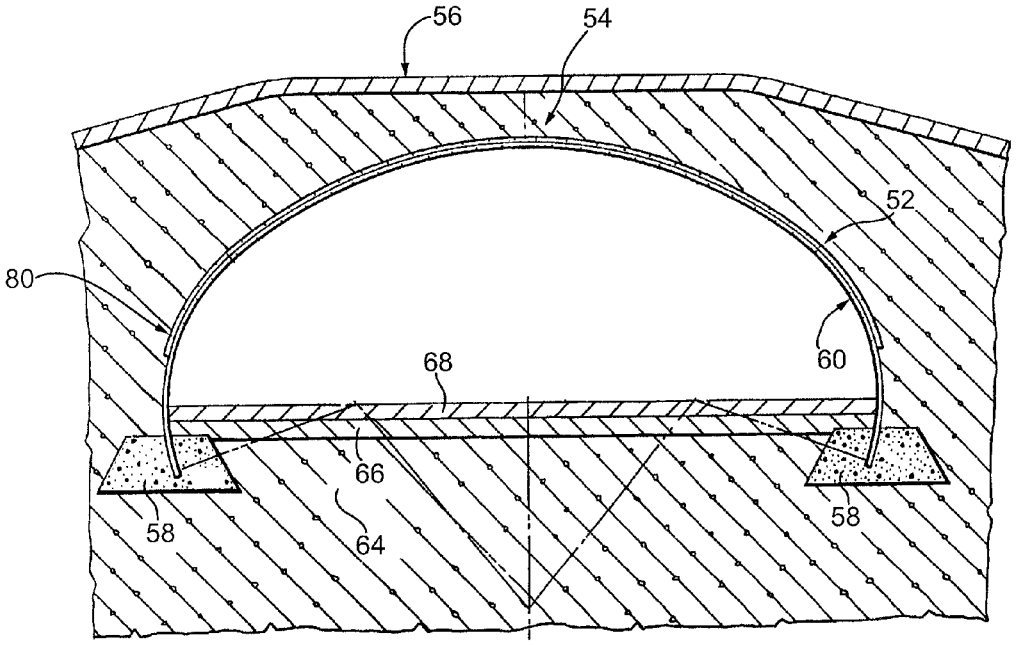
FIG. 4 is a cross-section of the arch-type structure of FIG. 2 taken along line 4-4.

The construction of underpass systems or similar thoroughfare infrastructure using large and/or long span metal overhead structures presents certain challenges. As one of skill in the art will appreciate, such overhead structures are subject to extreme stresses not only during the intended use (i.e. anticipated live/dead loads), but also during the initial construction process. Technology has enabled the construction of larger and longer overhead structures, as evidenced by U.S. Pat. No. 5,326,191 to Wilson et al. and U.S. Pat. No. 5,375,943 to McCavour et al., assigned to the assignee of the subject application. With larger overhead structures, the susceptibility of deformation and/or failure due to extreme forces imparted during the backfill process has required further technological development, as evidenced by U.S. Pat. No. 6,050,746 to McCavour et al., assigned to the assignee of the subject application. Not surprising, these technological advances have expanded the number of applications for such overhead structures resulting in new challenges presenting themselves.

Turning now to FIGS. 2 to 5, a representative underpass system or similar thoroughfare infrastructure is shown and is generally identified by reference numeral 50. As can be seen, the underpass system comprises an arch-type structure 52 constructed of interconnected metal plates or sheets. Above the arch-type structure 52 is a prescribed depth of overburden 54, on top of which is a roadway 56 constructed in the usual manner. The arch-type structure 52 comprises a pair of footings 58 and a metal archway 60 supported by the footings. The metal archway 60 is constructed from a plurality of interconnected structural corrugated metal plates or sheets 62 defining alternating crests 62*a* and troughs 62*b*. In this embodiment, the corrugated metal plates 62 are fastened together by bolts (not shown) so as to achieve the desired erected structure, although it will be appreciated that other alternate suitable fasteners meeting the specific structural and load requirements (welds, rivets, etc.) can be used. The footings 58 are placed on compacted fill 64, above which is a layer of compacted granular material 66. A roadway 68 formed of a layer of reinforced concrete and/or compacted asphalt is provided on the compacted granular material 66 and extends through the metal archway 60.

Figure 5:
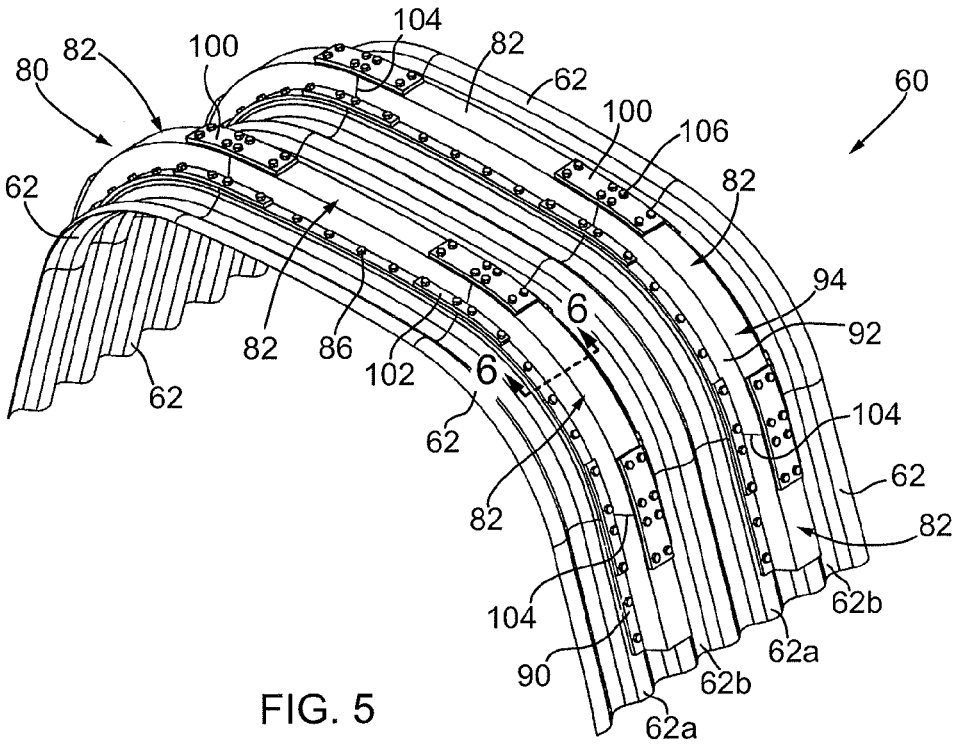
FIG. 5 is a perspective view of a portion of the metal archway of FIG. 3 showing reinforcement ribbing thereon.

To provide additional support and increase the load carrying capabilities of the arch-type structure 22, reinforcement ribbing generally identified by reference numeral 80 is secured to the metal archway 60 as best seen in FIG. 5. In this embodiment, the reinforcement ribbing 80 is provided at longitudinally spaced locations along the length of the metal archway 60 so that every other crest of the arch-type structure 52 is free of reinforcement ribbing 80. The reinforcement ribbing 80 extends transversely of the longitudinal length of the metal archway 60 to provide positive and negative bending resistance and combined bending and axial resistance to superimposed loads.

In this embodiment, at each location, the reinforcement ribbing 80 comprises a plurality of interconnected reinforcement ribs of similar configuration. In particular, the reinforcement ribbing 80 comprises a plurality of steel ribs 82 abutting in an end-to-end fashion so that the ribs 82 extend across the crown and along the haunches of the metal archway 60. The ribs 82 are secured to the metal archway 60 by suitable fasteners 86, in this case bolts. Of course, those of skill in the art will appreciate that other suitable means of securing the ribs 82 (welds, rivets, adhesive etc.) to the metal archway 60 may be employed.

Figure 6:
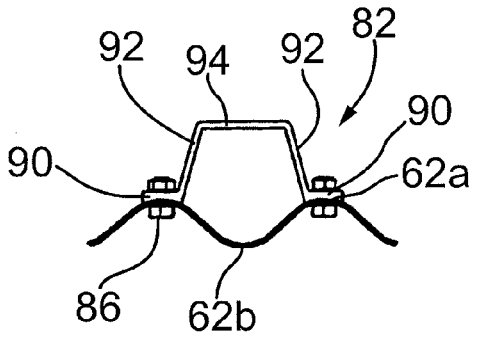
FIG. 6 is a cross-section of FIG. 5 taken along line 6-6 showing a reinforcement rib secured to the metal archway.

Turning now to FIG. 6, one of the ribs 82 is better illustrated. As can be seen, the rib 82 has an enclosed configuration when viewed from the end and comprises a pair of oppositely extending lower flanges 90 having curved undersurfaces, a sidewall 92 extending upwardly and inwardly from each lower flange 90 and a top wall 94 bridging the sidewalls 92. The rib 82 is dimensioned to span a trough **62*b* of the metal archway 60 so that the curved undersurfaces of the lower flanges 90 rest on adjacent crests 62*a* of the metal archway 60. Spaced holes are provided in the lower flanges 90 along their lengths to accommodate the bolts 86 that secure the reinforcement rib to the metal archway 60**.

The thickness of the top wall 94 and the height of the sidewalls 92 are chosen according to the intended load carrying characteristics of the arch-type structure 22. In typical applications, the sidewalls 92 will have a thickness in the range from about 1/16" to 1" and a height in the range of from about 2½" to 12". The top wall 94 will have a thickness in the range of from about 1/16" to 2". Of course, the dimensions of the sidewalls 92 and top wall 94 may deviate from the above ranges to suit the required load carrying characteristics of the arch-type structure 22. The longitudinal spacing of the reinforcement ribbing 80 and the configuration of the reinforcement ribbing (i.e. whether at each location the reinforcement ribbing comprises the same number of ribs 82) are also chosen according to the intended load carrying characteristics of the arch-type structure 22. In this manner, the configuration of the reinforcement ribbing 80 at each location and the reinforcement ribs 82 making up the reinforcement ribbing can be tailored to the specific application of the arch-type structure 22.

Connecting plates or splices 100 and 102 are provided at the interfaces or seams between abutting ribs 82. The connecting plates 100 span the top walls 94 of the ribs 82 and are secured to the ribs by suitable fasteners 104, in this case bolts. The connecting plates 102 span the lower flanges 90 of the ribs 82 and are secured to the ribs by the same fasteners 86 that are used to secure the ribs 82 to the metal archway 60.

The ribs 82 provide many advantages over conventional reinforcement ribs. Because the ribs 82 span adjacent crests **62*a* fewer fasteners are required to secure the ribs to the metal archway 60 as compared to conventional reinforcement ribs. In addition, fastening the ribs 82 to a pair of crests 62*a* provides better composite action as compared to the prior art ribs described previously. Also, the ribs 82 can be formed from metal plate using a roll-forming technique avoiding the need to use expensive extrusion. This allows larger ribs 82 to be formed. Forming the ribs in this manner also allows the ribs 82 to be curved while inhibiting twisting from occurring. As a result, the ribs 82 can be shaped to conform closely to the shape of the metal archway 60 facilitating attachment of the ribs 82 to the metal archway. In addition, the inward angle of the sidewalls 92 allows the ribs 82 to be stacked facilitating storage of the ribs as well as transportation of the ribs 82 to the site at which the underpass system 50** is to be constructed.

Figure 7:
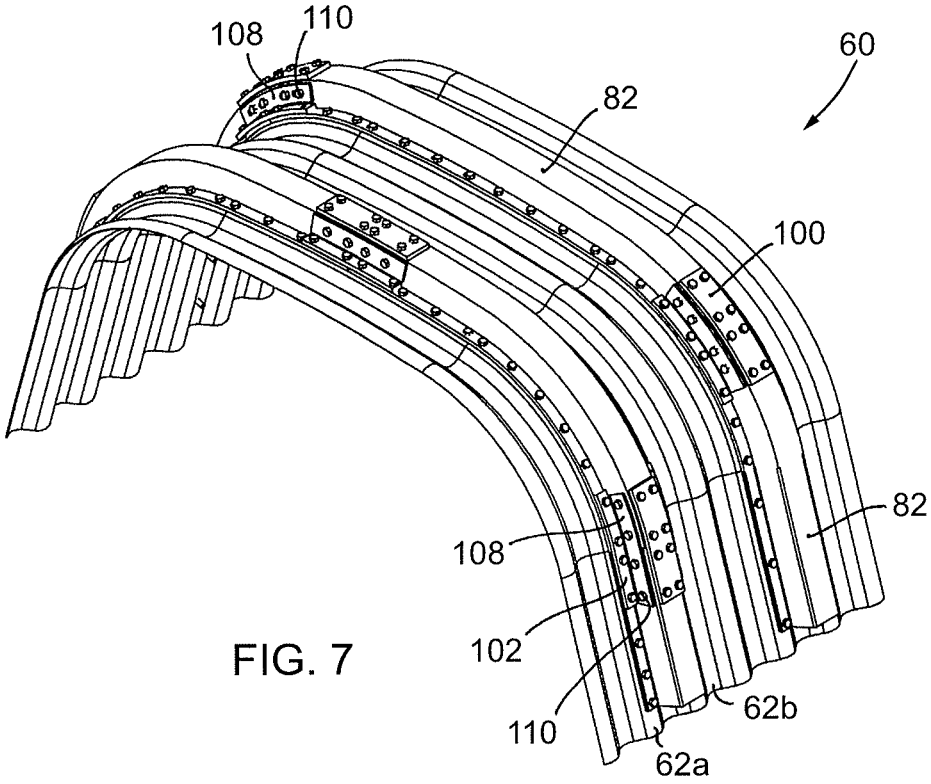
FIG. 7 is a perspective view of a portion of an alternative metal archway.

Although a particular embodiment of reinforcement ribbing 80 is described and shown above, those of skill in the art will appreciate that many variations are possible. For example, the ribs 82 need not be arranged so that the interfaces 104 between the ribs making up the reinforcement ribbing 82 at each location are in longitudinal alignment. The interfaces 104 between the ribs 82 may be staggered as shown in FIG. 7. In addition, connecting plates 108 spanning the sidewalls 92 of abutting ribs 82 may be employed. In this case, the connecting plates 108 are secured to the sidewalls 92 of the ribs 82 by fasteners 110, in this case bolts. Of course, fewer or no connecting plates may be employed.

Figure 8:
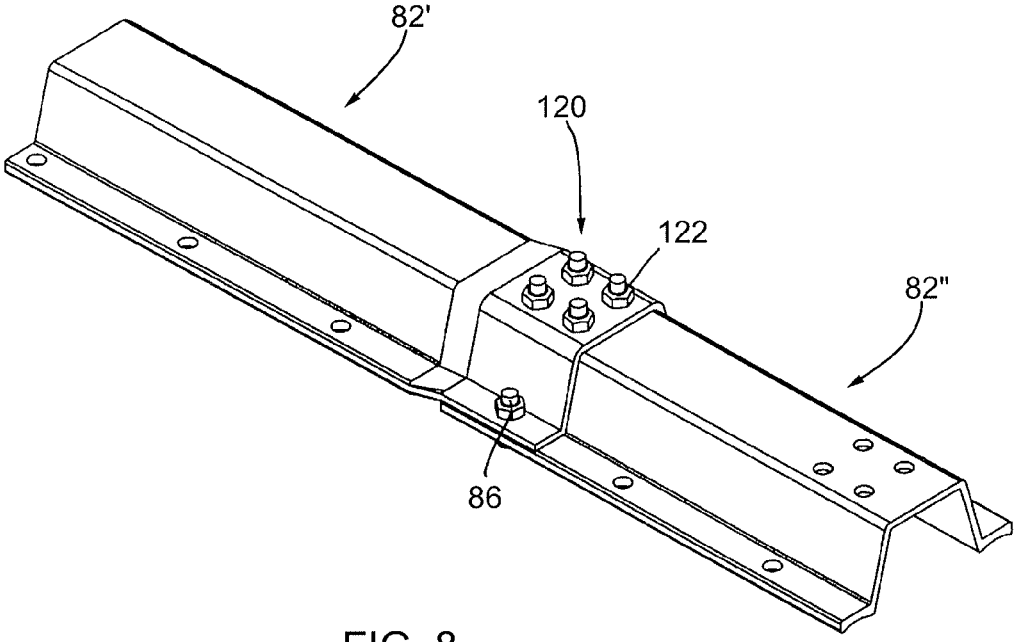
FIG. 8 is a perspective view of another embodiment of reinforcement ribbing.

Rather than arranging the ribs 82 in an end-to-end abutting fashion, the ends of adjacent ribs may be configured so that the ribs 82 overlap as shown in FIG. 8. In this embodiment, the end region 120 of one rib 82' is upwardly stepped allowing the end region 120 of the rib 82' to receive a corresponding end region of an adjacent rib 82" in a nested fashion. Fasteners 122 in the form of bolts pass through aligned holes in the top walls of the ribs 82' and 82" within the end regions to secure the ribs 82' and 82" together thereby obviating the need for connecting plates or splices.

Figure 9:
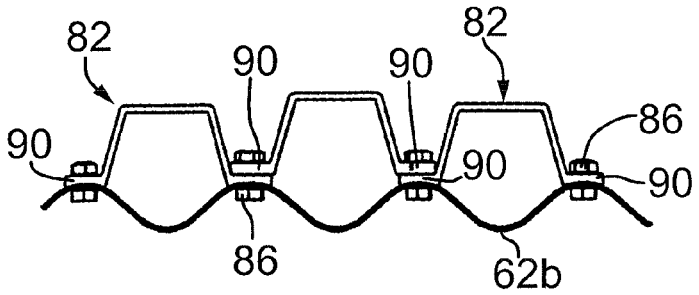
FIG. 9 is a cross-sectional view showing an alternative arrangement of reinforcement ribbing.

If desired, the reinforcement ribbing 80 can be provided on the metal archway 60 so that the reinforcement ribbing 80 spans consecutive troughs **62*b* as shown in FIG. 9. In this case, the lower flanges 90 of every other rib 82 rest of the lower flanges 90 of adjacent ribs 82 rather than directly on the crests 62*a*. Of course, the pattern or arrangement of the reinforcement ribbing 80 provided on the metal archway 60 can be varied as desired to suit the environment in which the arch-type structure 22** is deployed.

Figure 10:
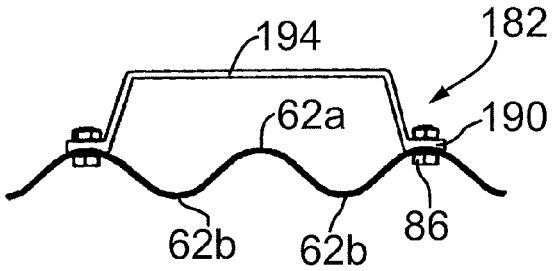
FIGS. 10 to 18 are cross-sectional views of alternative embodiments of reinforcement ribs.
Figure 11:
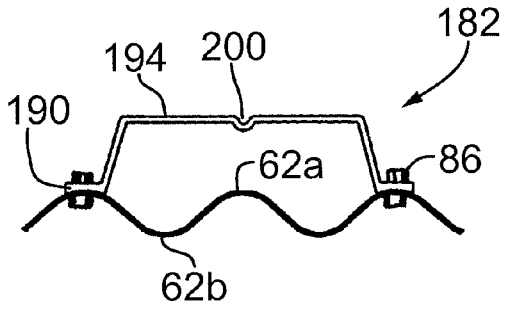
Figure 12:
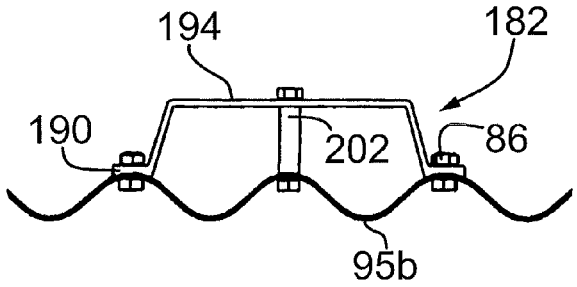

Other rib configurations are also possible. For example, although the ribs 82 are shown in FIGS. 1 to 9 as spanning adjacent crests **62*a* of the metal archway 60, the length of the span can of course be adjusted. Turning now to FIG. 10, a rib 182 having an increased width is shown. As can be seen, the lower flanges 190 of the rib 182 overlie every second crest 62*a* so that the top wall 194 overlies a pair of troughs 62*b* as well as a crest 62*a* of the metal archway 60. For larger spans, one or more longitudinal features, such as for example grooves 200 may be formed in the top wall 194 as shown in FIG. 11. Also, spacers 202 extending between the top wall 194 and the spanned crest 62*a* may be provided along the rib 182 at longitudinally spaced locations as shown in FIG. 12**.

Figure 13:
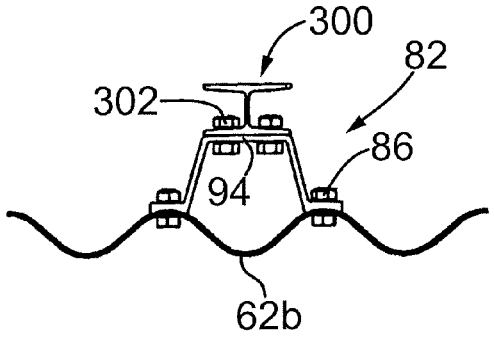
Figure 14:
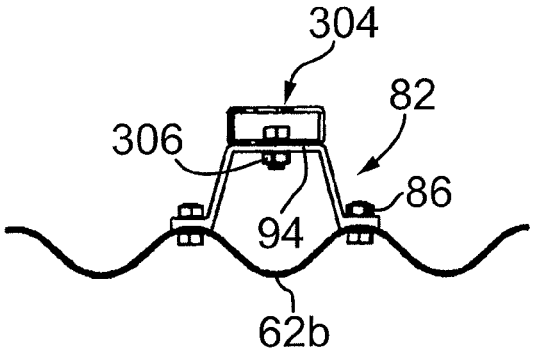
Figure 15:
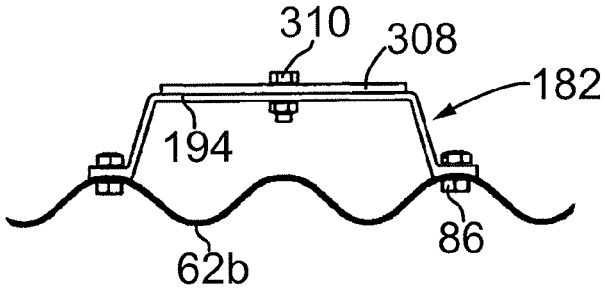

To provide further structural reinforcement to the arch-type structure 22, additional structural elements may be fastened to the top wall 94 of the ribs 82 or 182. For example, as shown in FIG. 13, I-beams 300 are secured to the top wall 94 of the ribs 82 by fasteners 302, in this case bolts. In FIG. 14, rectangular hollow channel members 304 are secured to the top wall 94 of the ribs 82 by fasteners 306, in this case bolts. In FIG. 15, flat rectangular plates 308 are secured to the top wall 194 of ribs 182 by fasteners 310, in this case bolts. Those of skill in the art will appreciate that the I-beams, rectangular channel members and flat plates are merely illustrative and that structural elements of different configurations can be used.

Figure 16:
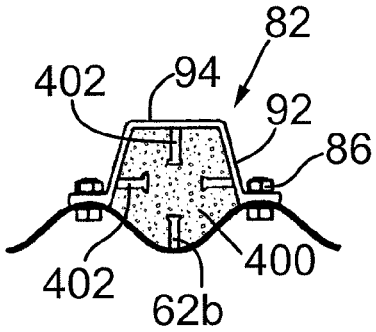

The interior space or cavity formed between the ribs 82 and the metal archway 60 may be filled with concrete 400 or other suitable material to provide additional reinforcement as shown in FIG. 16. In this case, shear studs 402 may be provided on the interior surfaces of the sidewalls 92 and/or top wall 94 and/or on the exterior surface of the metal archway 60 at spaced locations within the interior cavity 400 to enhance the bond at the concrete-metal interface.

Figure 17:
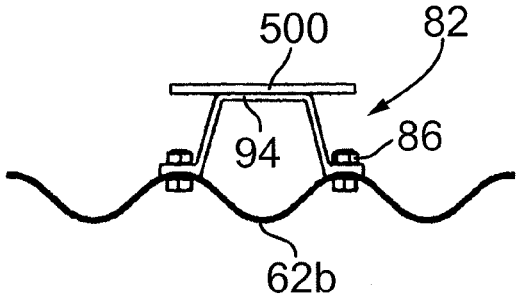
Figure 18:
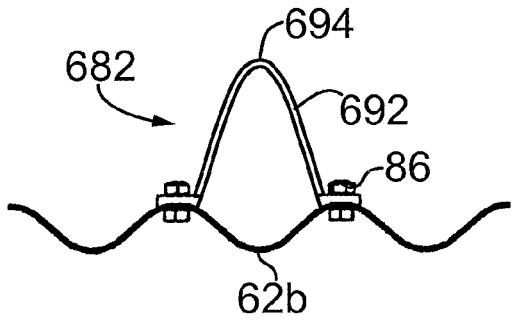

Still further rib configurations are possible. For example, flat plating 500 that extends beyond the sidewalls 92 to form overhangs may be welded or otherwise secured to the top wall 94 as shown in FIG. 17. Also, the sidewalls 629 and top wall 694 may be curved giving the rib 682 a cosine shape as shown in FIG. 18.

Figure 19:
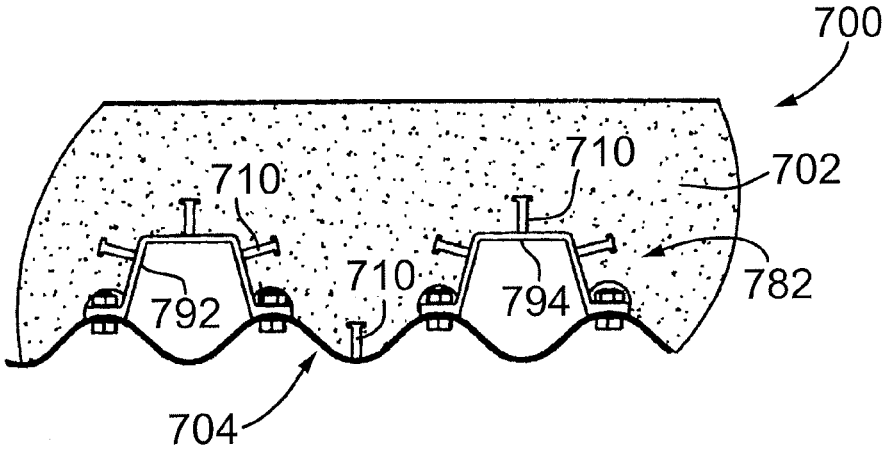
FIG. 19 is a cross-sectional view of an alternative overhead structure employing reinforcement ribbing.

In the embodiments described above, the overhead structure is arched and is shown in an underpass environment. Those of skill in the art will appreciate that the reinforcement ribbing 80 may be employed in other overhead structures including but not limited to box culverts, round and ovoid culverts, encased concrete structures and other similar structures used in underpass environments as well as in other environments. For example, FIG. 19 shows a road type structure 700 comprising a bed of concrete 702 or other suitable material defining a traveling surface applied directly onto a corrugated overhead structure 704 employing reinforcement ribbing 706. In this case, shear studs 710 are provided on the exterior surfaces of the top wall 794 and/or sidewalls 792 of the ribs 782 as well as on the corrugated overhead structure 704 to enhance the bond at the concrete-metal interface.

In addition, when steel is used to form the ribs 82, the ribs can be applied to steel and aluminized steel overhead structures making them suitable for use in marine environments.

Although embodiments have been described, it will be appreciated by those skilled in the art that variations and modifications may be made without departing from the spirit or scope thereof as defined by the appended claims.

What is claimed is:

1. An arch-shaped overhead structure comprising:

a curved metal archway having a crown section and haunch sections, said metal archway comprising a plurality of interconnected corrugated metal plates arranged to define corrugations extending transversely of the longitudinal length of said metal archway, said corrugations comprising alternating crests and troughs; and reinforcement ribbing secured to an outer surface of said metal archway at spaced locations along the longitudinal length of said metal archway so that at least one crest between successive spaced locations is free of reinforcement ribbing, at each of said spaced locations said reinforcement ribbing extending transversely of the longitudinal length of said metal archway along the crown and haunch sections of said metal archway, and at each of said spaced locations said reinforcement ribbing comprising a plurality of longitudinally curved, roll-formed, narrow and twist free elongate reinforcement ribs arranged in an end-to-end fashion, each of said reinforcement ribs being secured to a pair of crests and spanning at least one trough, each of said reinforcement ribs comprising a pair of laterally spaced generally planar sidewalls extending outwardly from said outer surface, a generally planar top wall spaced from the outer surface of said metal archway and extending between and bridging one end of each side wall and a generally planar lower flange extending from an opposite end of each sidewall, each lower flange overlying and being secured to a respective one of said pair of crests, wherein said sidewalls are inwardly angled in a direction towards the top wall and wherein an undersurface of each flange is concave and has a shape complimentary to that of the respective one of said pair of crests.

2. An overhead structure according to claim 1 wherein each lower flange is secured to the respective one of said pair of crests by at least one of fasteners, welds and adhesive.

3. An overhead structure according to claim 1 wherein at least at one of said spaced locations along the longitudinal length of said metal archway, the top wall of each reinforcement rib of said reinforcement ribbing also spans at least one crest.

4. An overhead structure according to claim 3 wherein at said at least one spaced location along the longitudinal length of said metal archway, at least one of said reinforcement ribs of said reinforcement ribbing further comprises at least one spacer extending between said at least one crest and said top wall.

5. An overhead structure according to claim 4 wherein said at least one reinforcement rib comprises a plurality of spacers extending between said at least one crest and said top wall at longitudinally spaced locations.

6. An overhead structure according to claim 3 wherein at said at least one spaced location along the longitudinal length of said metal archway, a plurality of said reinforcement ribs of said reinforcement ribbing further comprises at least one spacer extending between said at least one crest and said top wall.

7. An overhead structure according to claim 6 wherein each of said plurality of reinforcement ribs comprises a plurality of spacers extending between said at least one crest and said top wall at longitudinally spaced locations.

8. An overhead structure according to claim 1 wherein at a plurality of said spaced locations along the longitudinal length of said metal archway, the top wall of each reinforcement rib of said reinforcement ribbing also spans at least one crest.

9. An overhead structure according to claim 8 wherein at each of said plurality of spaced locations along the longitudinal length of said metal archway, at least one of said reinforcement ribs of said reinforcement ribbing further comprises at least one spacer extending between said at least one crest and said top wall.

10. An overhead structure according to claim 9 wherein said at least one reinforcement rib comprises a plurality of spacers extending between said at least one crest and said top wall at longitudinally spaced locations.

11. An overhead structure according to claim 8 wherein at each of said plurality of spaced locations along the longitudinal length of said metal archway, a plurality of said reinforcement ribs of said reinforcement ribbing further comprises at least one spacer extending between said at least one crest and said top wall.

12. An overhead structure according to claim 11 wherein each of said plurality of reinforcement ribs comprises a plurality of spacers extending between said at least one crest and said top wall at longitudinally spaced locations.

13. An overhead structure according to claim 1 wherein at least at one of said spaced locations along the longitudinal length of said metal archway, the top wall of each reinforcement rib of said reinforcement ribbing spans a single trough.

14. An overhead structure according to claim 1 wherein at a plurality of said spaced locations along the longitudinal length of said metal archway, the top wall of each reinforcement rib of said reinforcement ribbing spans a single trough.

15. An overhead structure according to claim 1 wherein at least at one of said spaced locations along the longitudinal length of said metal archway, at least one of said reinforcement ribs of said reinforcement ribbing further comprises at least one structural element on said top wall.

16. An overhead structure according to claim 15 wherein said at least one structural element is one of an I-beam, a channel member and a plate member.

17. An overhead structure according to claim 15 wherein said at least one structural element is one of fastened and welded to said top wall.

18. An overhead structure according to claim 1 wherein at least at one of said spaced locations along the longitudinal length of said metal archway, each of said reinforcement ribs of said reinforcement ribbing further comprises at least one structural element on said top wall.

19. An overhead structure according to claim 1 wherein at a plurality of said spaced locations along the longitudinal length of said metal archway, at least one of said reinforcement ribs of said reinforcement ribbing further comprises at least one structural element on said top wall.

20. An overhead structure according to claim 1 wherein at a plurality of said spaced locations along the longitudinal length of said metal archway, each of said reinforcement ribs of said reinforcement ribbing further comprises at least one structural element on said top wall.

21. An overhead structure according to claim 1 wherein at least at one of said spaced locations along the longitudinal length of said metal archway, the top wall of at least one of said reinforcement ribs of said reinforcement ribbing has at least one longitudinal feature thereon.

22. An overhead structure according to claim 21 wherein said at least one longitudinal feature is at least one groove formed in said top wall.

23. An overhead structure according to claim 1 wherein at least at one of said spaced locations along the longitudinal length of said metal archway, the top wall of each of said reinforcement ribs of said reinforcement ribbing has at least one longitudinal feature thereon.

24. An overhead structure according to claim 1 wherein at a plurality of said spaced locations along the longitudinal length of said metal archway, the top wall of at least one of said reinforcement ribs of said reinforcement ribbing has at least one longitudinal feature thereon.

25. An overhead structure according to claim 1 wherein at a plurality of said spaced locations along the longitudinal length of said metal archway, the top wall of each of said reinforcement ribs of said reinforcement ribbing has at least one longitudinal feature thereon.

26. An overhead structure according to claim 1, wherein at least at one of said spaced locations along the longitudinal length of said metal archway, each of said reinforcement ribs of said reinforcement ribbing further comprises at least one shear stud extending inwardly from an interior surface thereof.

27. An overhead structure according to claim 26 wherein at said at least one spaced location along the longitudinal length of said metal archway, each of said reinforcement ribs of said reinforcement ribbing comprises a plurality of shear studs extending inwardly from interior surfaces thereof.

28. An overhead structure according to claim 27 wherein said shear studs extend from interior surfaces of at least one of the sidewalls and said top wall.

29. An overhead structure according to claim 27 wherein said shear studs extend from interior surfaces of both of the sidewalls and said top wall.

30. An overhead structure according to claim 1, wherein at a plurality of said spaced locations along the longitudinal length of said metal archway, each of said reinforcement ribs of said reinforcement ribbing further comprises at least one shear stud extending inwardly from an interior surface thereof.

31. An overhead structure according to claim 30 wherein at each of said plurality of spaced locations along the longitudinal length of said metal archway, each of said reinforcement ribs of said reinforcement ribbing comprises a plurality of shear studs extending inwardly from interior surfaces thereof.

32. An overhead structure according to claim 31 wherein said shear studs extend from interior surfaces of at least one of the sidewalls and said top wall.

33. An overhead structure according to claim 31 wherein said shear studs extend from interior surfaces of both of the sidewalls and said top wall.

34. An overhead structure according to claim 30 wherein the interior of each reinforcement rib having a shear stud extending from an interior surface thereof is filled with concrete.

35. An overhead structure according to claim 1 wherein at least at one of said spaced locations along the longitudinal length of said metal archway, each of said reinforcement ribs of said reinforcement ribbing comprises a plurality of shear studs extending from exterior surfaces of at least one of said sidewalls and said top wall.

36. An overhead structure according to claim 35 wherein said shear studs extend from exterior surfaces of both of the sidewalls and said top wall.

37. An overhead structure according to claim 1 wherein at a plurality of said spaced locations along the longitudinal length of said metal archway, each of said reinforcement ribs of said reinforcement ribbing comprises a plurality of shear studs extending from exterior surfaces of at least one of said sidewalls and said top wall.

38. An overhead structure according to claim 37 wherein said shear studs extend from exterior surfaces of both of the sidewalls and said top wall.

39. An overhead structure according to claim 1 wherein at least at one of said spaced locations along the longitudinal length of said metal archway, said reinforcement ribbing further comprises at least one splice spanning adjacent ribs.

40. An overhead structure according to claim 1 wherein at least at one of said spaced locations along the longitudinal length of said metal archway, said reinforcement ribbing further comprises a plurality of splices spanning adjacent ribs.

41. An overhead structure according to claim 1 wherein at a plurality of said spaced locations along the longitudinal length of said metal archway, said reinforcement ribbing further comprises at least one splice spanning adjacent ribs.

42. An overhead structure according to claim 1 wherein at a plurality of said spaced locations along the longitudinal length of said metal archway, said reinforcement ribbing further comprises a plurality of splices spanning adjacent ribs.

43. An overhead structure according to claim 1 wherein at least at one of said spaced locations along the longitudinal length of said metal archway, end regions of adjacent reinforcement ribs of said reinforcement ribbing are nested.

44. An overhead structure according to claim 1 wherein at a plurality of said spaced locations along the longitudinal length of said metal archway, end regions of adjacent reinforcement ribs of said reinforcement ribbing are nested.

45. An overhead structure according to claim 1 wherein each sidewall has a thickness in the range from about 1/16" to 1" and a height in the range of from about 2½" to 12" and wherein the top wall has a thickness in the range of from about 1/16" to 2".

* * * * *